US005256846A

United States Patent [19]

Walters

[11] Patent Number: 5,256,846

[45] Date of Patent: Oct. 26, 1993

[54] MICROWAVEABLE BARRIER FILMS

[75] Inventor: Glenn J. Walters, Duxbury, Mass.

[73] Assignee: Advanced Dielectric Technologies, Inc., Taunton, Mass.

[21] Appl. No.: 755,082

[22] Filed: Sep. 5, 1991

[51] Int. Cl.[5] ..... H05B 6/80

[52] U.S. Cl. ..... 219/10.55 E; 219/10.50 F; 426/107; 426/113; 426/234; 426/243; 99/DIG. 14; 428/323

[58] Field of Search ..... 219/10.55 E, 10.55 F, 219/10.55 M; 99/DIG. 14; 426/107, 234, 243, 113; 428/323

[56] References Cited

U.S. PATENT DOCUMENTS

| | | | |
|---|---|---|---|
| 3,219,460 | 11/1965 | Brown | 219/10.55 E |
| 4,230,924 | 10/1980 | Brastad et al. | 219/10.55 E |
| 4,266,108 | 5/1981 | Anderson et al. | 219/10.55 E |
| 4,495,392 | 1/1985 | Derby | 219/10.55 E |
| 4,656,325 | 4/1987 | Keefer | 219/10.55 E |
| 4,676,857 | 6/1987 | Scharr et al. | 426/107 |
| 4,883,936 | 11/1989 | Maynard et al. | 219/10.55 F |
| 4,894,503 | 1/1990 | Wendt | 219/10.55 E |
| 4,904,836 | 2/1990 | Turpin et al. | 219/10.55 F |
| 4,933,193 | 6/1990 | Fisher | 426/107 |
| 4,940,867 | 7/1990 | Peleg | 219/10.55 |
| 4,959,516 | 9/1990 | Tighe et al. | 219/10.55 E |
| 4,962,000 | 10/1990 | Emslander et al. | 428/461 |
| 4,962,293 | 10/1990 | Lackey | 219/10.55 F |
| 4,963,424 | 10/1990 | Beckett | 428/209 |
| 4,985,300 | 1/1991 | Huang | 428/332 |
| 5,006,405 | 4/1991 | Watkins | 428/323 |
| 5,019,681 | 5/1991 | Lorence et al. | 219/10.55 E |
| 5,021,293 | 6/1991 | Huag et al. | 426/107 |
| 5,038,009 | 8/1991 | Babbitt | 219/10.55 E |
| 5,041,295 | 8/1991 | Perry et al. | 426/107 |
| 5,185,506 | 2/1993 | Walters | 219/10.55 E |

*Primary Examiner*—Bruce A. Reynolds
*Assistant Examiner*—Tu Hoang
*Attorney, Agent, or Firm*—Wolf, Greenfield & Sacks

[57] ABSTRACT

Shelf stable packaging films and packages which are microwaveable yet are substantially impermeable to gases and ultraviolet energy and selectively permeable to microwave energy are described. The films include a water vapor and oxygen barrier substrate having a first side upon which is deposited a metallic coating capable of selectively transmitting a portion of a microwave energy field through the substrate. The coating is formed in a plurality of discrete, microwave reflective areas separated by non-reflective gaps. The shape and spacing of the areas is varied so that the microwave energy transmission through non-coated areas of the barrier is sufficient to avoid arcing and heat the object but not cook the object. A food packaging system for storing and heating food by microwave energy, which includes the microwave barrier film of this invention, is also described.

21 Claims, 4 Drawing Sheets

MICROWAVEABLE BARRIER FILMS

FIELD OF THE INVENTION

The present invention relates to microwave barrier films for use in packaging of microwaveable food products in which the barrier film has reduced permeability to oxygen, ultraviolet radiation and water vapor yet is designed to allow transmittance of microwave energy to produce warming of food products contained within the packaging.

BACKGROUND OF THE INVENTION

It is well known that a thin metal film can absorb substantial amounts of microwave energy and convert this energy into thermal energy for heating a variety of food products. These thin metal films are commonly called susceptors. The susceptor is typically associated in conductive heat transfer relationship with a food product contained in the package and is usually bonded to a structural supporting sheet. There have been many attempts to provide food packages or composite materials that become hot when exposed to microwave radiation.

Many snack foods and other pre cooked foods are currently packaged in some type of bag or carton which also utilizes metallized film in combination with a material having structural properties. The purpose of the metallized film in this context is to create an oxygen barrier and a water barrier to extend the shelf life of the food product at the retail location. In the past, some packaged foods have utilized a laminate of a thin foil and a polymer film. The foil provides a barrier to ultraviolet radiation, oxygen and water vapor while the film provides strength against punctures and tearing. Recently, however, most of these constructions have been replaced by a film or a laminate thereof which has been metallized with a layer of aluminum. This construction is more cost-effective than the foil laminated structure.

These metallized bags cannot conductively heat food because they have too thick a metallic coating to act like a susceptor. These metallized bags also reflect a substantial amount of incoming microwave energy and they effectively prevent microwaves from heating the food directly. Further, in the case of barrier metal coatings on a polymeric substrate, only a small amount of microwave reflection can be achieved before arcing occurs, destroying the barrier properties of the polymeric sheet as well as the structure of the metallic coating. Arcing may also adversely affect the microwave oven and in some circumstances may even result in a fire. Thus, current packaging structures that contain a foil or metallized film coating to act as an impermeable barrier to prolong shelf life cannot also be used to heat food in a microwave oven without fear of fires or arcing because they have a tendency to reflect up to 100% of the energy away from the food.

SUMMARY OF THE INVENTION

The present invention relates to a microwave barrier film that allows direct heating of packaged foods using microwave energy. The barrier film is less susceptible to microwave induced heating and/or arcing and is substantially impermeable to ultraviolet radiation, water vapor and gaseous oxygen. These effects are achieved by providing a barrier film having discrete microwave reflective elements. By judicious selection of the number, type and arrangement of reflective elements, the microwave barrier film can seal the food item against spoilage and minimize arcing between areas of metallized coatings. Furthermore, the barrier film acts as a filter which allows sufficient microwave energy to pass through the laminate so that packaged food is warmed (i.e. heated and/or cooked).

The invention includes at least one insulative material substantially transparent to microwave energy, upon which is provided a plurality of microwave-reflective elements that cover a large surface area of the microwave transparent material, thereby forminq a barrier that is substantially impermeable to oxygen, ultraviolet radiation and water vapor. Moreover, the reflective elements are designed to have known microwave reflectance characteristics, thereby forminq a barrier selectively permeable to microwave radiation and capable of reducing the amount of microwave energy that is transmitted through the microwave transparent material and into the environment of use.

In one embodiment of the invention, the barrier film includes a first substrate having opposed first and second surfaces that is substantially transparent to microwave energy comprising an electrical insulator, preferably a polymeric film. Means for reflecting microwave energy received thereon are deposited on a surface of the first substrate. The reflecting means comprise one or more metallized coatings deposited on the first substrate in a pattern as noncontiguous elements that are spaced-apart from each other. Alternately, a uniform reflective coating can be deposited and subsequently de-metallized in selected regions to provide smaller areas lacking microwave reflectivity within a larger reflective coating. The means on the first substrate for reflecting microwave energy allows the barrier film to be selectively permeable to microwave energy, so that only a portion of the microwave energy received passes through the electrically insulative substrate to directly heat the packaged food.

In another embodiment, the barrier film includes a first substrate having opposed surfaces and means for reflecting microwave energy deposited on both of the opposed surfaces of the substrate. The reflecting means comprise one or more metallic, noncontiguous elements. Preferably, the elements disposed on opposite sides of the substrate are not aligned, the elements being in "phased array".

In another embodiment of the invention, the barrier film can be one component of a shelf-stable and self-supporting sealed food package for storing and then heating the stored food. The package can include the barrier film of the invention, the film including a first microwave transparent substrate and means for reflecting microwave energy. A second substrate is usually affixed to the barrier film having sufficient mechanical integrity to provide dimensional stability to the barrier film. The means for reflecting microwave energy can be a plurality of noncontiguous elements. Microwave energy is either reflected away from the substrates by the elements and/or selectively transferred between the elements and exits into the environment of use.

DETAILED DESCRIPTION OF THE INVENTION

The microwave barrier film of the invention is designed to create a shelf-stable packaging material for food, which film is substantially impermeable to certain radiation and chemicals. The term "impermeable" means that the film allows reduced transfer of water vapor, oxygen and ultraviolet radiation from one side of the barrier to the other side of the barrier. The term "shelf stable" refers to that property of the barrier film package for food which allows the food products to have a long shelf-life. The microwave barrier film includes one or more substrates which are provided with reflective elements in a predetermined pattern. The pattern is selected in order to eliminate arcing and to provide a patterned barrier material that is selectively permeable to microwaves. As used herein, the term "selectively permeable" means that the reflective elements reflect the incident microwave radiation in such a manner as to allow only some portion of the impinging microwave radiation to pass through the substrate(s) and directly warm or cook, the food via microwave heating effects without arcing.

Furthermore, when used in a microwave oven, the barrier film will not itself act as a susceptor and will not undergo substantial heating due to microwave absorption. As used herein, the term "warm" means that the barrier film allows microwave radiation to pass having energy sufficient to raise the temperature of the food to no greater than about 150° -250° F. At this temperature range, the packaged food is heated to a temperature sufficient to warm, re-warm or cook it. It is understood that the barrier film of this invention is designed to be used in combination with consumer type microwave ovens operating at 2450 MHz and between about 400 watts to about 800 watts.

Figure 1:
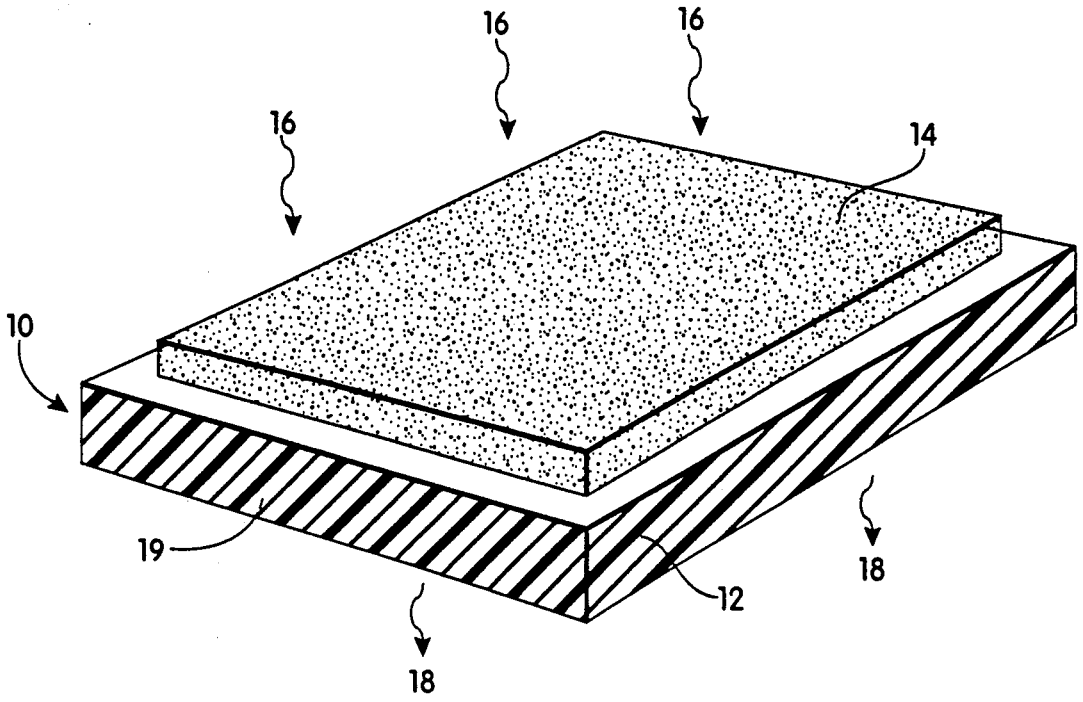
Fig. 1 (Prior Art)
FIG. 1 is a schematic illustration of the microwave field changes caused by the barrier film.

Some prior art films that act as susceptors are illustrated schematically in FIG. 1 which shows a film 10, including a substrate zone 12 and a metallic coating zone 14. As used herein and throughout the specification, the term "zone" means a region or area distinct from an adjacent area by a sharp boundary or by a gradual change. A zone can include one or more layers. A microwave source (not shown) produces a microwave energy field 16 that impinges upon coating zone 14. Typically, the microwave energy field 16 is produced by a magnetron of a microwave oven. The coating zone 10 is designed to absorb a portion of the incoming microwave energy. Typically, a maximum of about 30%-40% of the microwave power may be absorbed by the susceptor and about 50-70% is transmitted. The remainder is reflected back towards the microwave source. A portion, therefore, of the microwave radiation 18 is absorbed by coating zone 10 and substrate zone 12 and is converted into radiative thermal energy sufficient to heat, cook, or crisp the food directly as heat transferred across interface 19 of the substrate zone. These prior art susceptor films cannot be used as an effective packaging barrier since they are too permeable to oxygen and water vapor and generate too high a temperature when exposed to microwave radiation.

Figure 2:
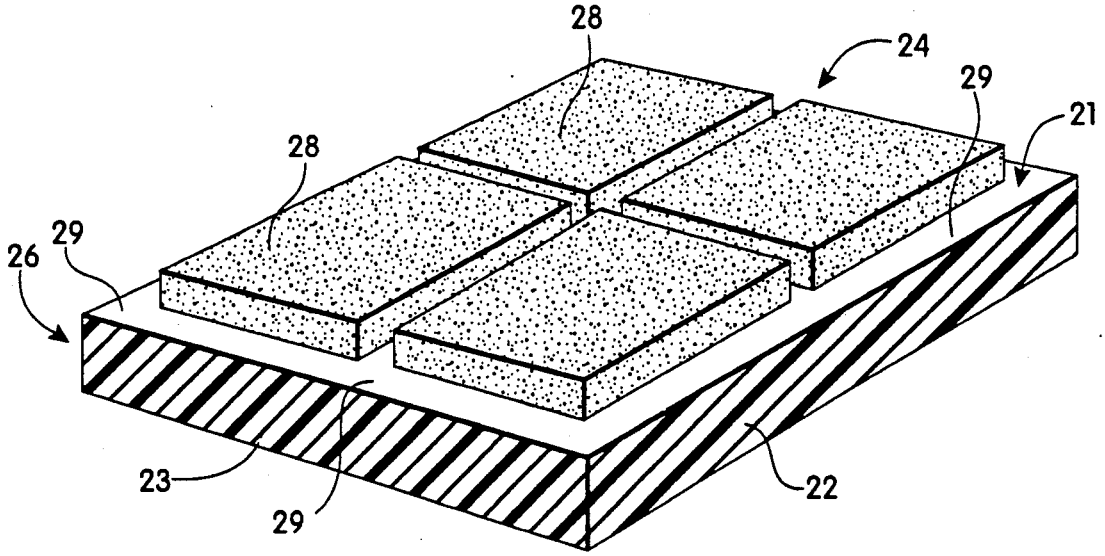
FIG. 2 is a schematic, perspective representation of one embodiment of a microwave barrier film having a discontinuous reflecting film.

The present invention, depicted in FIG. 2, is not a susceptor. The film comprises a planar substrate zone 22 having opposed first and second surfaces 21, 23. A barrier coating zone 24 is deposited on surface 21 of substrate 22 for reflection of a portion of the microwave radiation to which the substrate is exposed, defining a barrier film 26. By varying the pattern and reflectivity of coating zone 24, the barrier film can be made resistant to arcing, substantially impermeable to gases and certain electromagnetic radiation wavelengths (particularly UV light) and selectively permeable to microwave energy. That is, the barrier film 26 can control the amount of microwave energy transferred through the substrate zone 22 and across surface 23 between the substrate zone and the environment of use so that the film is not substantially heated.

As illustrated in FIG. 2, the barrier film preferably can include a microwave reflective coating zone 24 as a series of noncontiguous, discrete patterns 28 deposited upon surface 21 of the substrate zone 22. The patterns can be in the form of a series of discrete circles, parallel stripes, triangles, or any other pattern to allow portions of the microwave field to directly contact the substrate surface 21 in the gaps 29 between the discrete patterns 28 without being reflected. FIG. 2 depicts a particularly preferred configuration of a barrier film 26, in which a plurality of square reflective elements 28 is deposited onto the first surface 21 of substrate 22. The squares are about 5.0 mm on a side and are separated from each other by a coating free gap 29 of about 0.2 mm. In this embodiment, about 80-98% of the surface area of the substrate is covered. It will be appreciated that reflective elements 28 and their adjacent coating-free gaps 29 can be made of different dimensions without departing from the functional properties and scope of this invention. For example, the coating-free gap between adjacent squares can range from about 0.1 mm to about 1.0 mm. The reflective elements can range from about 3.0 mm to about 20 mm on a side. The width of the coating free gap combined with the properties of the substrate and the coating thickness, will determine the precise barrier properties. These properties will, in turn, define the amount of microwave energy radiated to the food.

The microwave reflective coatings can be applied by any deposition process that will not damage the substrate or the deposited coating. In one embodiment, a vapor deposition process is preferred. This vapor deposition process can be any process in which materials are deposited upon substrates from the vapor phases. Deposition methods such as chemical and physical vapor deposition (CVD, PVD) which includes sputtering, ion plating, electroplating, electron beam and resistive or inductive heating are intended to be included herein. While methods for providing the reflective coating material in the vapor phase are preferred, the invention is not intended to be limited by the method of forming the barrier reflective coating. Rather, any method for applying microwave reflective coatings can be used, provided the method does not substantially damage the substrates upon which the coatings are being deposited.

The microwave reflective coating(s) interact with the electric and/or magnetic components of the microwave energy field. A portion of the microwave energy directed upon the reflective zone is reflected, a portion absorbed, and a portion transmitted into the substrate zone, the absorbed energy being converted into thermal energy. Equations for calculating the relative values of the reflected, absorbed and transmitted energy are given in the literature, see for example, R. L. Ramey et al., "Properties of Thin Metal Films at Microwave Frequencies", *J. Appl. Phys.*, Vol. 39(3), (1968).

For maximum reflection of impinging microwaves, it can be calculated that the resistivity of the reflective zone must be substantially less than the resistivity of the medium through which the microwave energy passes (i.e. in most cases, free space or some other insulative medium). Theoretically, for optimum reflection, the resistivity of the reflective coatings should be substantially less than about 377 ohms per square, the resistivity of free space.

Referring again to FIG. 2, the discrete elements 28 of the reflective coating zone 24 can range in resistivity from about 0.1 to about 4.0 ohms per square. Most preferably, the elements have a resistivity of less than about 1.0 ohms per square and can comprise a coating of a single metal, a metal alloy, a metal oxide, a mixture of metal oxides, a dispersion of reflective metallic or reflective non-metallic materials in a binder, or any combination of the foregoing. Generally, any material can be used capable of easily reflecting, or otherwise dissipating microwave energy. Suitable exemplary metals include aluminum, iron, tin, tungsten, nickel, stainless steel, titanium, magnesium, copper and chromium. Preferably, the reflective elements comprise aluminum, aluminum alloy or other metal coatings. A thicker layer for the reflective element is preferred. In a thicker layer, reflection is favored over transmission and absorption. More significantly, a thick metal coating is required for barrier properties.

The substrate zone upon which the microwave reflective coating zone is deposited preferably comprises an electrical insulator, e.g., a polymeric film which can be oriented or unoriented. Materials considered to be useful as the substrate zone include insulative materials that can already act to some degree as a barrier to oxygen gas and water vapor, for example, polyolefins (e.g. polypropylene, polyethylene), polyesters, polyamides (e.q. nylon), polyimides, polysulfones, polyethers, ketones, cellophanes and various blends of such materials. Insulative substrate materials can also include paper and paper laminates, metal oxides, silicates and cellulosics. In one embodiment, the substrate zone comprises a polyester film of the order of approximately 0.2 mil to approximately 2 mil thick. A thickness of approximately 0.5 mil is preferred.

The embodiment of the invention depicted in FIG. 2 can be alternatively fabricated by a process in which a relatively thick reflective coating is deposited upon a surface of the substrate and then selectively removed using any of a variety of removal techniques known in the art to form the desired pattern. The removal is preferably complete so that coating material is removed down to the substrate surface.

Figure 3:
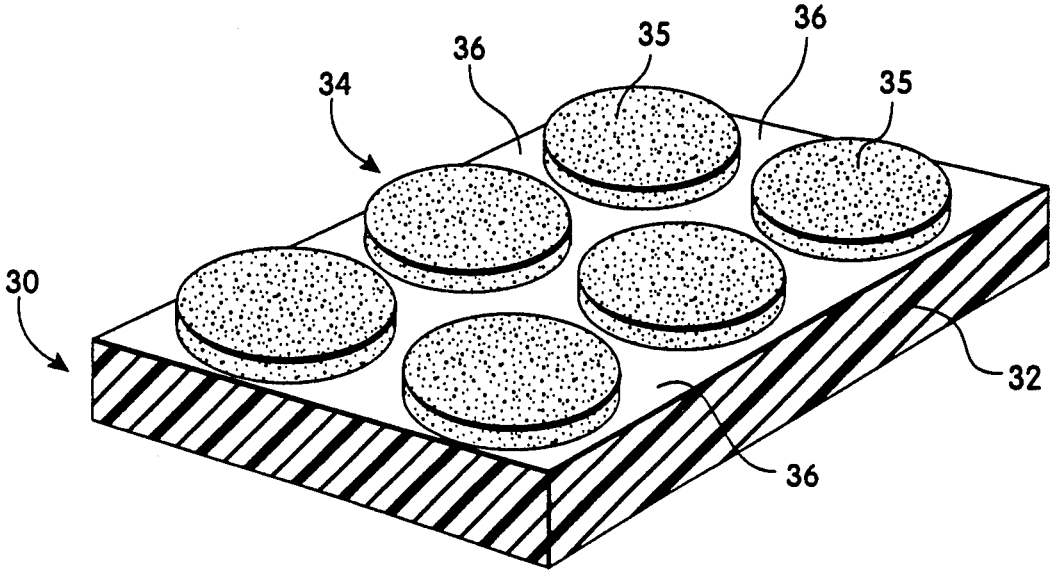
FIG. 3 is a schematic, perspective representation of a second embodiment of a microwave barrier film for food packaging.

For example, as illustrated in FIG. 3, the microwave-reflective coating can comprise a series of geometric patterns originally deposited as a uniform layer, with pattern formation occurring during subsequent de metallization steps. FIG. 3 depicts a barrier film 30 with a substrate 32 upon which is deposited a reflective coating 34 having a pattern comprising a plurality of discrete, circular areas 35 separated by coating free gaps 36. The reflective coating 34 of the pattern can be other geometric or non geometric designs (e.q., pseudo random patterns) without departing from the scope of this invention.

Figure 4:
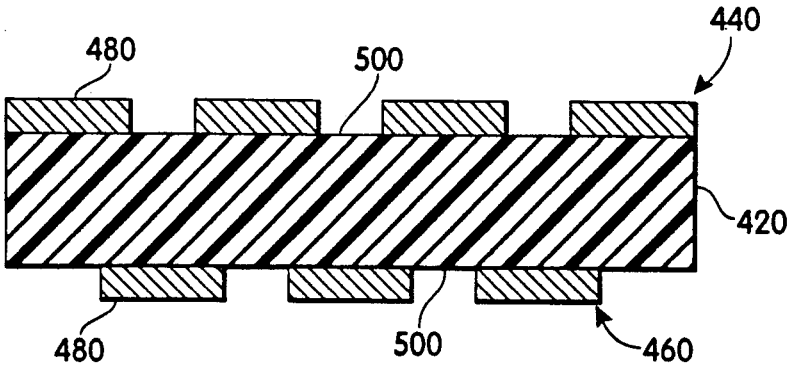
FIG. 4 is a cross sectional representation of another embodiment of a microwave barrier film for food packaging.

A preferred embodiment of the microwave-reflective coating configuration includes a planar polymeric substrate, as described above, having opposed surfaces. This substrate is sandwiched between two microwave reflective layers, which layers are deposited on the opposed surfaces of the polymeric substrate. Each microwave-reflective layer preferably includes discontinuous rectangular metallic elements that are separated from each other by a continuous nonmetallic gap or slot. Preferably, the metallic elements on the opposed surfaces are in phased array. The term "phased array" refers to displacement of one microwave-reflective layer relative to the other microwave reflective layer so that some or all of the metallic elements and nonmetallic gaps are not substantially aligned. Thus, some part of one microwave-oven reflective layer is occluded from some part of the other layer and microwaves passing substantially normal to the surface of one of the metallic layers would encounter a reflective metallized surface at the opposite side of the substrate. This can best be illustrated by reference to the cross section of FIG. 4. An insulative substrate 420 is sandwiched between two microwave reflective layers 440, 460. Each layer comprises a plurality of reflective microwave elements 480 separated from each other by a non reflective gap or slot 500. The layers are displaced with respect to each other. The microwave energy impinging upon one of the layers will be substantially or only partially reflected from the substrate, depending upon the relative displacement of the two microwave reflective layers.

While not wishing to be bound by any particular theory, it is believed that the array of microwave-reflecting, noncontiguous coating elements deposited on a surface of the substrate will reflect or divert a large amount of microwave energy without creating a surface charge or current in the coating sufficient to cause arcing. A possible explanation of the effect of the barrier is that microwave energy tends to diffract when passing across the elements of the barrier in much the same manner that light diffracts when the light wavefront is partially blocked off by an opaque object containing an aperture.

Five parameters are varied to control the degree of reflectivity of a pattern of metallic elements to microwave energy: size and shape of the metallic elements, width of the gap between the elements, conductivity of the material formed in the element, thickness of the metallic layer, and displacement of the elements relative to each other on opposed surfaces of the substrate (i.e phased array). For a given material and layer thickness, increasing the size of the metallic elements may increase the current within the metallic element and increase the reflected microwave energy.

It is well within the ordinary skill of those in the art to select the particular material of the reflecting coating regions, as well as the physical dimensions of the region such as coating pattern, thickness, width and pitch, and control both the degree of impermeability, the degree to which the reflective coating regions will reflect microwave energy and the amount and distribution of microwave energy that is transmitted through the polymeric substrate in the gaps between the regions of reflecting material. Thus, food packaging incorporating the barrier film of this invention can be designed to be shelf stable and designed to subsequently heat food to a predetermined temperature (e.q. 100° F., 150° F., 200° F. and the like).

The barrier of this invention can therefore be incorporated into a self supporting receptacle as food packaging for use in microwave ovens and for microwave warming of food. As previously illustrated in FIGS. 2–4, the insulative substrate upon which the reflecting material is deposited can be made of a material strong enough to provide some dimensional stability and preferably surrounds at least part of the food product.

Figure 5:
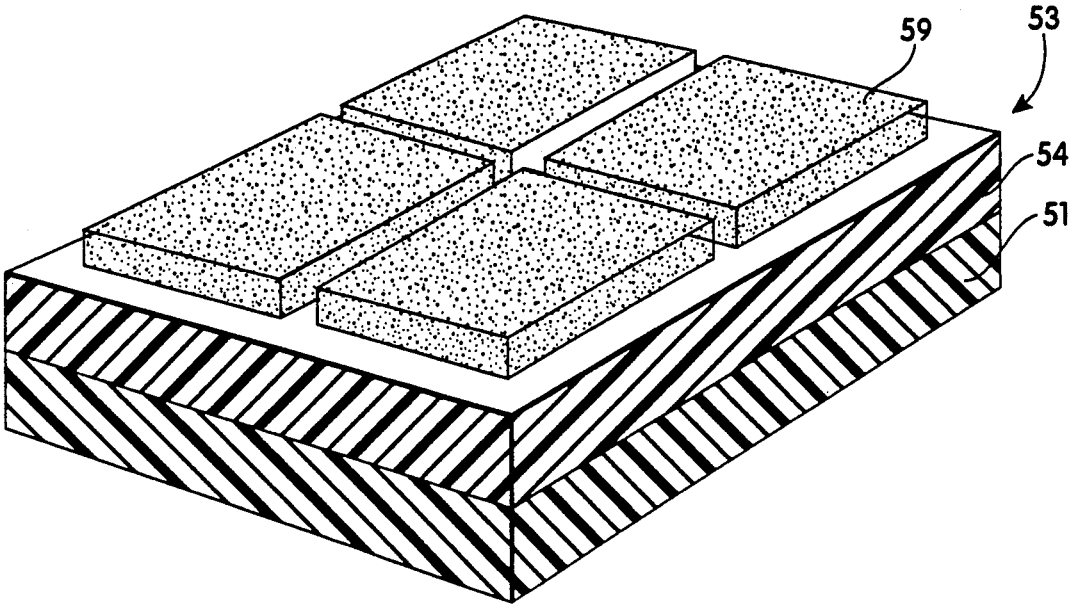
FIG. 5 is a schematic, perspective representation of an embodiment of a microwave barrier film for use in a food packaging system.
Figure 6:
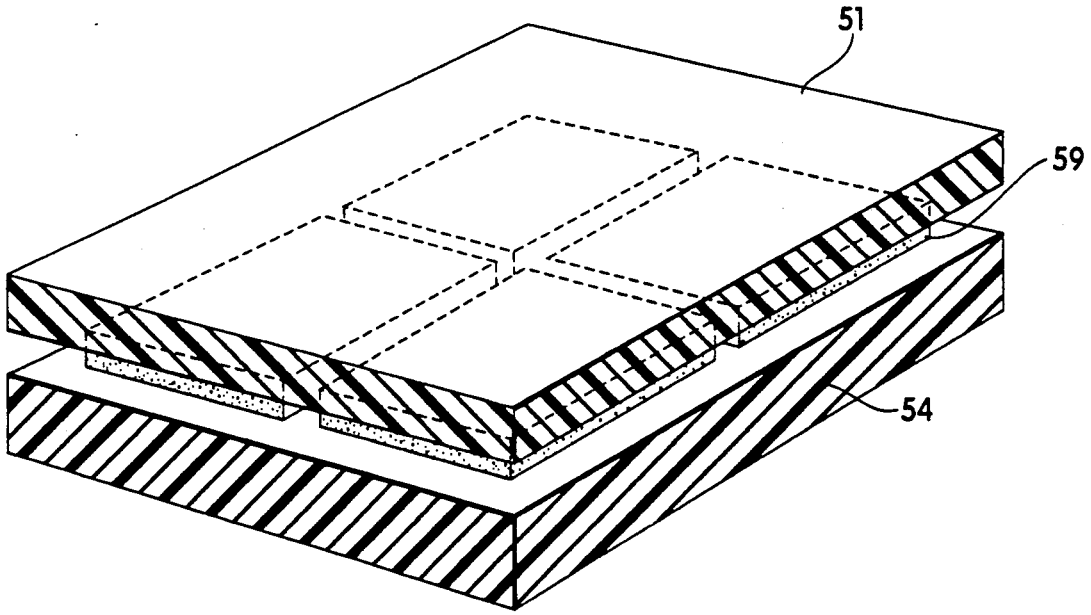
FIG. 6 is a schematic, perspective representation of another embodiment of a microwave barrier film for food packaging.

Furthermore, as illustrated in FIG. 5, a barrier film 53 of another embodiment of the invention preferably includes a first insulative substrate 51 onto which is deposited a plurality of discrete, microwave-reflective elements 59. Receptacles of this embodiment also include a second microwave transparent and insulative substrate 54 that is affixed to either the first insulative substrate 51 (FIG. 5), the microwave-reflective elements 59, or both first substrate 51 and reflective elements 59, as a "sandwich" configuration as illustrated in FIG. 6, in which all reference numbers are identical to those in FIG. 5. The second microwave transparent substrate 51, may be a sheet of paper or a paperboard to provide further structural rigidity. The layers can be affixed to each other with adhesives exposed between the layers. It is preferred that the adhesive have sufficient thermal stability to prevent zones to which it is adhered from separating or curling during the operation of the microwave barrier film. Pressure sensitive adhesives can be used and are well-known in the art. Such adhesives useful in the present invention can include water-based adhesives, silicone based adhesives, e.q. polysiloxanes, acrylic based adhesives, rubber-based adhesives, e.q. styrene-isoprene-styrene block copolymers, and nitrile rubbers. The layers can also be affixed to each other without adhesives by utilizing insulative substrates that can be heat sealed together. A number of heat-sealable, thermoplastic materials are known and act, to some degree, as barriers to oxygen and water vapor including ethylene copolymers such as ethylene vinyl acetate copolymers, polyvinylidene chloride and thermoplastic polyester copolymers having melting points of about 50° C. to about 200° C. Examples of polyester copolymers include those selected from copolymers of ethylene qlycol, terephthalic acid and azelaic acid; copolymers of ethylene qlycol, terephthalic acid and isophthalic acid and the like.

Figure 7:
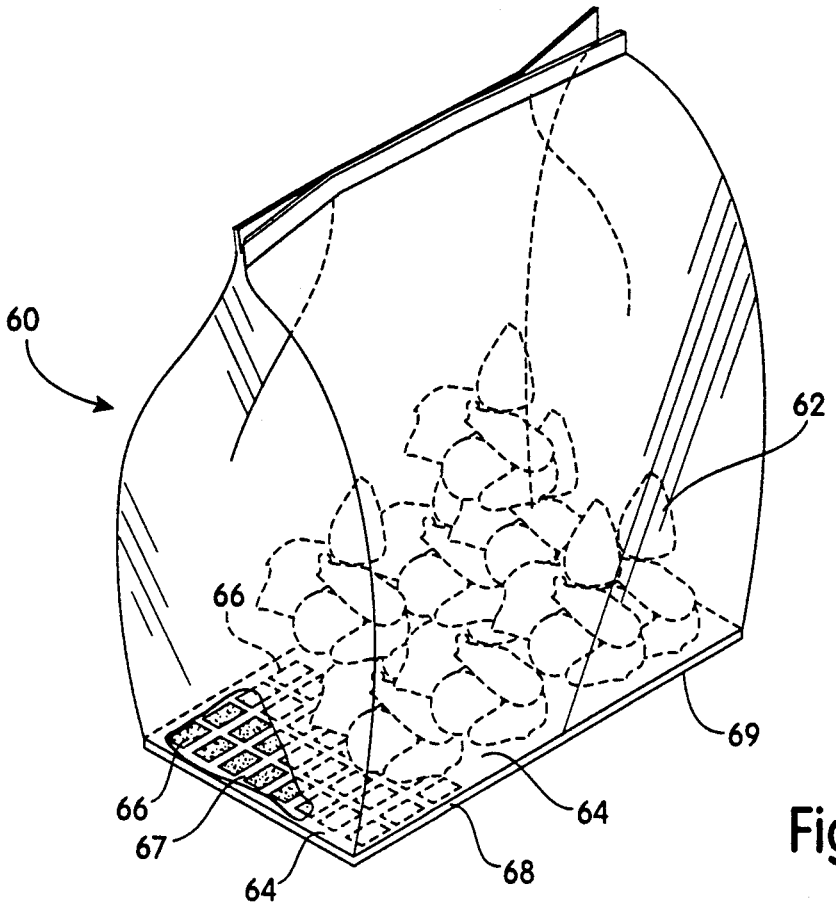
FIG. 7 is a perspective illustration of a heat-sealable food packaging system of the invention showing the components of the barrier film in cut-away section.

FIG. 7 illustrates a food receptacle 60 of the invention that includes food 62 such as popcorn, chips and the like. Although receptacle 60 is a heat sealed bag, it is understood that the receptacle can be any self supporting shape; for some snack foods, a box shape might be preferred. In the embodiment illustrated in FIG. 7, the barrier film includes a first substrate 64 onto the lower surface of which is deposited a plurality of noncontiguous reflective elements 66 that are separated from each other by a non reflective gap 67. A second microwave transparent substrate 68 is affixed to the reflective elements 66. This food receptacle configuration includes the "sandwich"-type barrier film, previously shown in FIG. 6. In FIG. 7, substrate 68 is affixed to the reflective elements 66 about the bottom 69 of receptacle 60. It is understood that substrate 68 can be affixed on all surfaces of receptacle 60. Other barrier film constructions could also be employed in receptacles of the type illustrated herein such as those of FIGS. 2–5.

Figure 8:
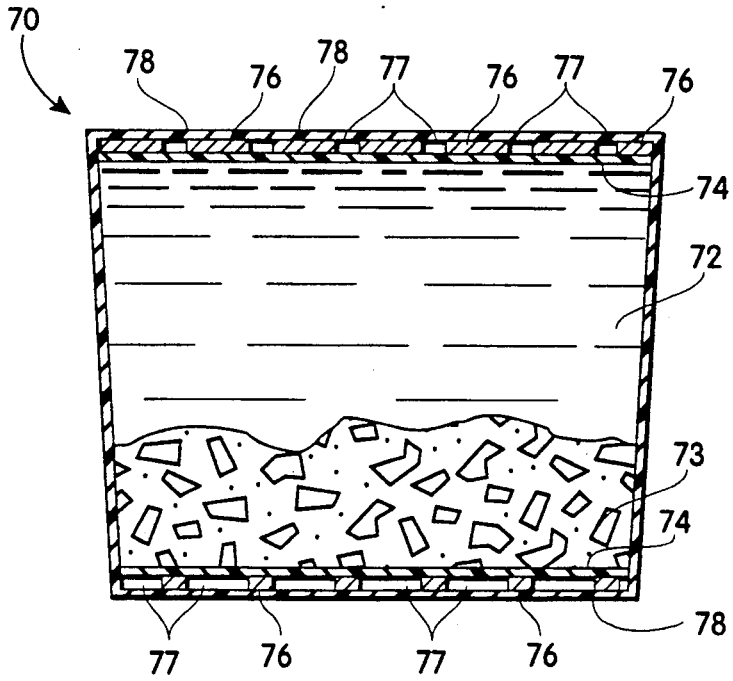
FIG. 8 is a cross-section representation of another food packaging system of the invention.

FIG. 8 illustrates an embodiment of the invention that is a receptacle 70 for storing liquids such as soups and the like aseptically (i.e. free from microorqanisms). The receptacle and its contents can be warmed within a microwave oven. Although receptacle 70 is a self supporting box, it is understood that the receptacle can be any self supporting shape; for other liquids, a bag shape might be preferred. In the embodiment illustrated in FIG. 8, the barrier film includes a first substrate 74 onto which is deposited a plurality of noncontiguous reflective elements 76 that are separated from each other by a non reflective gap 77. A second microwave transparent substrate 78 is affixed to reflective elements 76. FIG. 8 illustrates an embodiment designed to heat liquids that contain particulate material, such as chicken soup, alphabet soup and the like. Frequently, the particulate fractions of these soups will not heat up as fast as the liquid fraction. The particulate components of the soup are represented at the bottom of the receptacle 70 as component 73 and the liquid fraction of the soup 72 is represented as floating above the particulate fraction 73. The embodiment of FIG. 8 is selectively permeable to microwaves, the package capable of differentially warming the soup so that microwave penetration into the particulate fraction of the liquid is enhanced. This can be accomplished by providing larger gaps 77 at the bottom of the receptacle than at the top of the receptacle, thus effectively shielding the top of the receptacle from microwave-induced heating. Alternately, the reflective elements 76 at the bottom of the receptacle can be smaller then those at the top of the receptacle. These structures will allow microwave energy to penetrate into the particulate fraction. Substrate 78 is affixed to reflective elements 76 at the top and bottom of receptacle 70. It is understood that substrate 78 can be affixed to all surfaces of receptacle 70. Moreover, other constructions of the barrier film of the invention could also be employed in receptacles of the type illustrated in FIG. 8. It will be appreciated that those of ordinary skill in the art could readily determine particular placement and patterning of non reflective elements in order to determine the optimum heating characteristics of a particular aseptic packaging material.

The barrier film of the invention affixed to one or more microwave transparent layers comprises the entire packaging system. The barrier film does not itself become substantially heated but allows a small portion of microwave energy to pass between the microwave transparent gaps between reflective elements to warm the food directly. The barrier film is substantially impermeable to ultraviolet radiation and certain gases and is provided with enough structural integrity to form various configurations of microwave food packaging systems.

Many other configurations of microwave barrier films for a food packaging system can be readily developed by those skilled in the art without significantly departing from the scope of this invention.

EQUIVALENTS

Although the specific features of the invention are shown in some drawings and not in others, this is for convenience only, as each feature may be combined with any or all of the other features in accordance with the invention.

It should be understood, however, that the foregoing description of the invention is intended merely to be illustrative thereof, that the illustrative embodiments ar presented by way of example only, that other modifications, embodiments, and equivalents may be apparent to those skilled in the art without departing from its spirit.

Having thus described the invention, what I desire to claim and secure by Letters Patent is:

1. A microwave barrier film for use in shelf stable packaging, comprising:

a first substrate that is substantially transparent to microwave energy, the substrate having a first surface for receiving incident microwave energy and a second surface in facing relation to the first surface;

microwave-reflective means deposited as a pattern on each said first and second surfaces for barring oxygen, water vapor and ultraviolet energy from passing through the film, the microwave-reflective means on said first surface displaced relative to said microwave-reflective means on said second surface, said microwave-reflective means substantially incapable of generating heat when exposed to microwave energy and capable of allowing only a portion of the incident microwave energy to pass through the film so that arcing does not occur.

2. The barrier film of claim 1, further comprising a second substrate affixed to the barrier film, said second substrate having sufficient mechanical integrity to provide dimensional stability to the barrier film.

3. The barrier film of claim 1, wherein said first and second microwave-reflective means comprises noncontiguous, elements spaced apart from each other by a non-microwave reflective gap, said elements covering between about 80% to about 98% of each of said first and second surfaces.

4. The barrier film of claim 3, wherein the elements are square and range from about 0.3 cm to about 2.0 cm on a side.

5. The barrier film of claim 3, wherein the non-microwave reflective gap ranges from about 0.1 mm to about 1.0 mm in width.

6. The barrier film of claim 3, wherein the elements include metal-containing materials selected from the group consisting of a single metal, a metal alloy, a metal oxide, a mixture of metal oxides, a dispersing of metals, and a combination of said metal-containing materials thereof.

7. A microwaveable package for heating food, the package substantially incapable of arcing when exposed to microwaves, the package comprising:

a barrier film for surrounding at least part of a food product to be heated, the barrier film including a microwave transparent and dimensionally stable first substrate having a plurality of elements substantially reflective of microwaves, said elements deposited on a first side of the first substrate in a patterned configuration, said elements deposited on a second side f the first substrate in a patterned configuration that is displaced relative to the elements on said first side, so that said elements of said first and second sides are not aligned, the barrier film constructed and arranged to be substantially impermeable to oxygen, water vapor and ultraviolet energy, said elements providing selective permeability of microwave energy to the barrier film so that only a portion of an applied microwave energy field passes through the substrate to directly warm the food product, said elements substantially incapable of generating heat when exposed to microwaves.

8. The package of claim 7, wherein the portion of the applied microwave energy field passing through the barrier film is sufficient to heat the food product to about 250° F.

9. The package of claim 7, wherein the noncontiguous elements are square and range from about 0.3 cm to about 2.0 cm on a side.

10. The package of claim 9, wherein the noncontiguous elements are separated from each other by a gap that ranges from about 0.1 mm to about 1.0 mm in width.

11. The package of claim 7, wherein the noncontiguous elements include metal-containing materials selected from the group consisting of a single metal, a metal alloy, a metal oxide, a mixture of metal oxides, a dispersion of metals, and any combination of the foregoing.

12. The package of claim 10, wherein the metal is selected from the group consisting of aluminum, iron, tin, tungsten, nickel, stainless steel, titanium, magnesium, copper, and chromium.

13. A microwaveable package for storing and warming of foods, comprising:

a dimensionally stable first substrate that is substantially transparent to microwave energy;

a barrier film affixed to the first substrate, the barrier film including a microwave-transparent second substrate with opposed surfaces, said substrate having a plurality of noncontiguous elements deposited on said opposed surfaces in phased array, said elements substantially incapable of generating heat when exposed to microwave energy, the barrier film constructed and arranged to be substantially impermeable to oxygen, water vapor and ultraviolet energy, said noncontiguous elements providing selective permeability to the barrier film so that only a portion of the microwave energy received on the elements passes through the first and second substrates, said portion available to directly warm said foods.

14. The package of claim 13, wherein the portion of the microwave energy passing through the first and second substrates is sufficient to warm the food to between about 150° F. and about 250° F.

15. The package of claim 13, wherein the noncontiguous elements are square and range from about 0.3 cm to about 2.0 cm on a side.

16. The package of claim 15, wherein the noncontiguous elements are separated from each other by a gap that ranges from about 0.1 mm to about 1.0 mm in width.

17. The package of claim 16, wherein the noncontiguous elements include metal-containing materials selected from the group consisting of a single metal, a metal alloy, a metal oxide, a mixture of metal oxides, a dispersion of metals, and any combination of the foregoing.

18. The package of claim 17, wherein the metal is selected from the group consisting of aluminum, iron, tin, tungsten, nickel, stainless steel, titanium, magnesium, copper, and chromium.

19. A barrier film for use in food packaging and for microwave warming of food, comprising:

a substrate that is substantially transparent to microwave energy, the substrate having a first surface for receiving incident microwave energy and a second surface in facing relation to the first surface;

a plurality of noncontiguous and microwave-reflective elements deposited on the first and second surfaces for substantially reducing a transmission of oxygen, water vapor and ultraviolet energy through the barrier film, said microwave-reflective elements substantially incapable of converting microwave energy into heat, the elements constructed and arranged in phased array to allow only a portion of the incident microwave energy to pass through the film in order to warm food directly by microwaves.

20. The barrier film of claim 19, wherein the noncontiguous and microwave-reflective elements have a resistivity of between about 0.1 and about 4.0 ohms per square.

21. The barrier film of claim 20, wherein the non-contiguous and microwave-reflective elements have a resistivity of less than about 1 ohm per square.

* * * * *